US011125032B2

(12) United States Patent
Spencer

(10) Patent No.: US 11,125,032 B2
(45) Date of Patent: Sep. 21, 2021

(54) MPD WITH SINGLE SET POINT CHOKE

(71) Applicant: Nabors Drilling Technologies USA, Inc., Houston, TX (US)

(72) Inventor: Danny Spencer, Houston, TX (US)

(73) Assignee: Nabors Drilling Technologies USA, Inc., Houston, TX (US)

( * ) Notice: Subject to any disclaimer, the term of this patent is extended or adjusted under 35 U.S.C. 154(b) by 258 days.

(21) Appl. No.: 16/512,563

(22) Filed: Jul. 16, 2019

(65) Prior Publication Data

US 2020/0040677 A1 Feb. 6, 2020

Related U.S. Application Data

(60) Provisional application No. 62/712,628, filed on Jul. 31, 2018.

(51) Int. Cl.
*E21B 21/08* (2006.01)
*E21B 47/09* (2012.01)
*E21B 21/10* (2006.01)

(52) U.S. Cl.
CPC ..... *E21B 21/08* (2013.01); *E21B 21/106* (2013.01); *E21B 47/09* (2013.01)

(58) Field of Classification Search
CPC ..... E21B 21/08; E21B 21/106; E21B 47/06; E21B 47/09; E21B 21/00; E21B 21/082; E21B 21/085
See application file for complete search history.

(56) References Cited

U.S. PATENT DOCUMENTS

2006/0207795 A1* 9/2006 Kinder ..... E21B 21/08 175/38

FOREIGN PATENT DOCUMENTS

WO 2017023710 A1 2/2017

OTHER PUBLICATIONS

Vega, Márcia Peixoto; et al. "Automatic Monitoring and Control of Annulus Bottom Hole Pressure for Safe Oil Well Drilling Operations." Chemcial Engineering Transactions. vol. 26, 2012, pp. 339-344.

MPowerD™ Managed Pressure Drilling System Case Study. "Automated MPD Choke System Addresses Drilling Challenges." National Oilwell Carco. Accessed Mar. 2018.

i-balance Control System. "The high precision of i-balance Control System is ideally suited for narrow-margin managed pressure drilling (MPD) applications." Product Spec Sheet. M-I Swaco, 2015.

* cited by examiner

*Primary Examiner* — James G Sayre
(74) *Attorney, Agent, or Firm* — Abel Schillinger, LLP; Enrique Abarca

(57) ABSTRACT

Systems and methods for conducting subterranean operations and managing a bottom hole pressure (BHP) in a wellbore include receiving a first signal at a controller indicating a drill pipe connection or disconnection is beginning and switching the controller from a first control mode to a second control mode. The bottom hole pressure (BHP) in the wellbore is determined, a BHP set point is determined by the controller, and a first pressure set point is sent to a single set point choke (SSPC). The BHP is maintained by comparing the determined BHP to the BHP set point and adjusting the first pressure set point based on the comparison. The controller receives a second signal after the drill pipe connection or disconnection is complete prompting the controller to switch back to the first control mode.

20 Claims, 5 Drawing Sheets

MPD WITH SINGLE SET POINT CHOKE

CROSS-REFERENCE TO RELATED APPLICATION

This application claims priority under 35 U.S.C. § 119(e) to U.S. Provisional Patent Application No. 62/712,628 entitled "MPD with Single Set Point Choke," by Danny Spencer, filed Jul. 31, 2018, which is assigned to the current assignee hereof and incorporated herein by reference in its entirety.

FIELD OF DISCLOSURE

The following is directed to a method and system for subterranean drilling operations, and particularly, to a method and system for automatically managing bottom hole pressure in a wellbore with a single set point choke.

BACKGROUND

In the managed pressure drilling (MPD) of wellbore or reservoir fluidic systems, choke valves can be used to regulate fluid flow from a wellbore to control back pressure of fluid received from an annulus, thereby regulating (or managing) a pressure profile in the wellbore. Rigs may have several chokes and/or choke manifolds to manage a wellbore pressure profile. A pressure profile in the wellbore is often maintained by monitoring and maintaining an annulus pressure proximate the bottom of the wellbore, which can be referred to as a bottom hole pressure (BHP). Managing the BHP during subterranean operations, such as drilling, can help protect the integrity of an uncased portion of the wellbore. For example, when pipe segments are connected to a drill string, mud pumps may be ramped down until the flow is "0" zero GPM. An equivalent circulating density (ECD) can decrease in response to the reduced circulation of the drilling fluid through the drill string and the annulus, which can in turn cause a decrease in the BHP. With reduced BHP, a kick can likely occur. Therefore, it can be beneficial to maintain pressure in the wellbore and thereby limit the reduction in the BHP during a drill pipe connection. A traditional method of maintaining pressure during MPD operations is to generate and follow a pump ramp schedule. Following the schedule, the driller may change the pump(s) GPM and an MPD operator may change a surface backpressure set point, according to the schedule. This can happen in stages and should be well coordinated to avoid potential mistakes. This method is dependent upon the driller and/or MPD operator to follow the schedule and depends upon the driller and/or MPD operator to take corrective actions if behavior of the well is not as planned. This method is a "hands-on" technique and can be prone to operator errors which can lead to BHP values outside the desired range and result in unfavorable well conditions.

SUMMARY

In one aspect, a method for conducting a subterranean operation is provided. The method can include operations of receiving a first signal at a controller; switching the controller from a first control mode to a second control mode in response to receiving the first signal; determining a bottom hole pressure (BHP) in a wellbore; receiving a BHP set point at the controller and sending a first pressure set point to a single set point choke (SSPC); maintaining the BHP by adjusting the SSPC to track the first pressure set point; comparing the determined BHP to the BHP set point and adjusting the first pressure set point based on the comparing; receiving a second signal at the controller; and switching the controller back to the first control mode in response to the second signal.

In another aspect, a system for use in subterranean operations is provided that can include a managed pressure drilling assembly consisting of; a single choke; a pressure sensor; and a controller configured to change the mode of the single choke between a manual set point mode that maintains a surface backpressure during drilling and an automated mode that automatically maintains a bottom hole pressure (BHP) based on a BHP set point during drill pipe connections, wherein in the automated mode the controller is configured to receive pressure data and continuously send instructions to a choke controller to maintain the BHP within a first desired pressure range, and wherein the choke controller is configured to control a state of the single choke based on the instructions.

The foregoing has outlined rather broadly and in a non-limiting fashion the features and technical advantages of the present invention in order that the detailed description of the invention that follows may be better understood. Additional features and advantages of the invention will be described hereinafter. It should be appreciated by those skilled in the art that the conception and specific embodiments disclosed may be readily utilized as a basis for modifying or designing other structures for carrying out the same purposes of the present invention. It should also be realized by those skilled in the art that such equivalent constructions do not depart from the scope of the invention as set forth in the appended claims.

BRIEF DESCRIPTION OF THE DRAWINGS

The present disclosure may be better understood, and its numerous features and advantages made apparent to those skilled in the art by referencing the accompanying drawings.

DETAILED DESCRIPTION

Certain aspects of the present disclosure relate to the arrangement and control of a single set point choke (SSPC) deployed in a wellbore environment, where the SSPC can regulate fluid flow from an annulus in the wellbore. The SSPC functions to regulate fluid flow through the SSPC based on parameters such as a set point pressure. The status of and fluid flow conditions within the SSPC can be monitored and measured, providing data to a controller element, where the controller element can adjust the SSPC as needed to regulate fluid flow from the annulus by maintaining backpressure at the SSPC at or near a desired level (i.e. a set point pressure). The adjustment of the SSPC can be an automatic process, operating according to settable parameters that can alter the state of the SSPC, and thereby control pressure in the connected wellbore.

Figure 1:
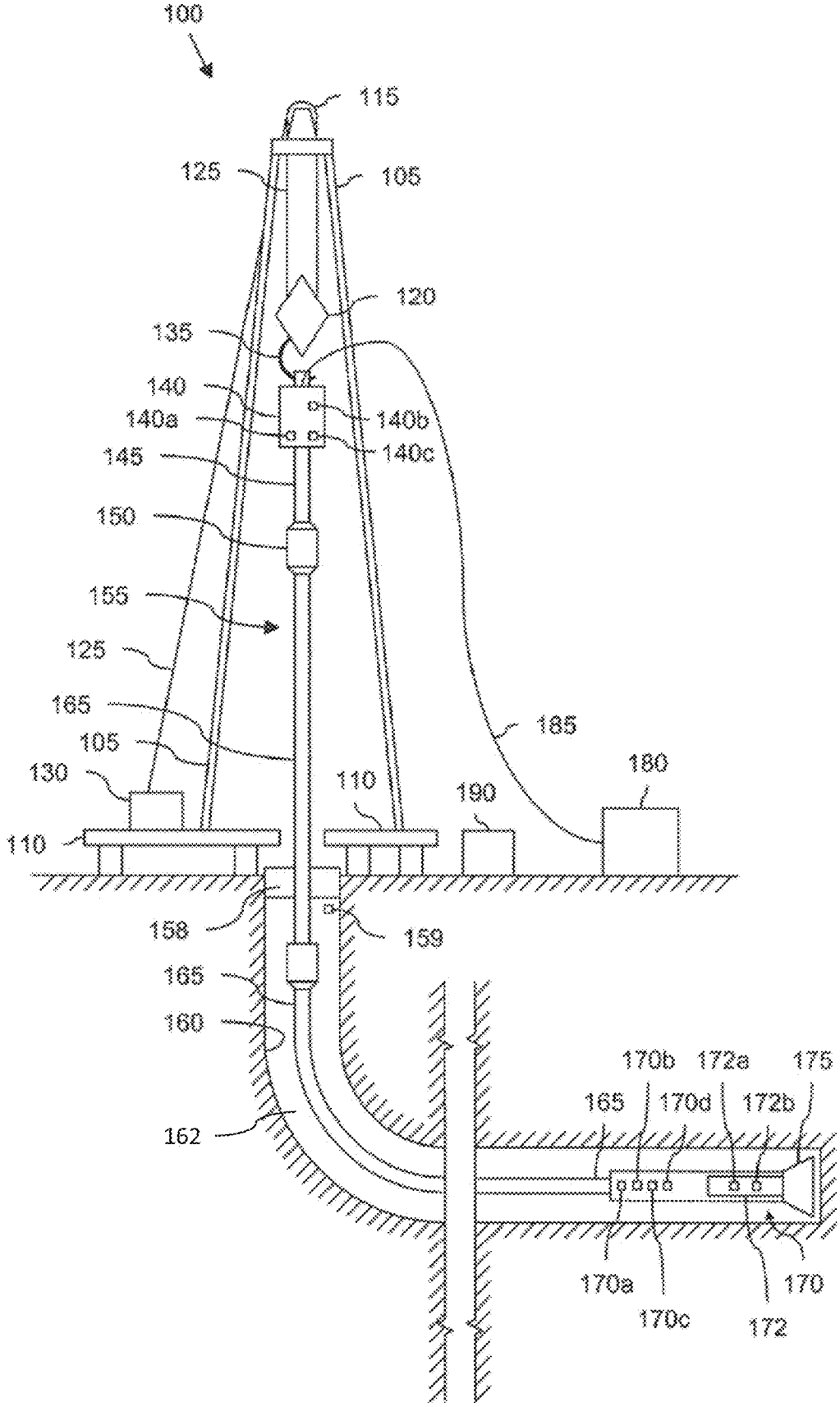
FIG. 1 is a schematic diagram of a drilling rig system according to one or more aspects of the present disclosure.

FIG. 1 is a schematic diagram of a drilling rig according to one or more aspects of the present disclosure. As illustrated, the drilling rig 100 is or includes a land-based drilling rig. However, one or more aspects of the present disclosure are applicable or readily adaptable to any type of drilling rig, such as jack-up rigs, semisubmersibles, drill ships, coil tubing rigs, well service rigs adapted for drilling and/or re-entry operations, and casing drilling rigs, among others within the scope of the present disclosure.

The drilling rig 100 includes a mast 105 supporting lifting gear above a rig floor 110. The lifting gear includes a crown block 115 and a traveling block 120. The crown block 115 may be coupled at or near the top of the mast 105, and the traveling block 120 hangs from the crown block 115 by a drilling line 125. One end of the drilling line 125 extends from the lifting gear to drawworks 130, which may be configured to reel out and reel in the drilling line 125 to cause the traveling block 120 to be lowered and raised relative to the rig floor 110. The other end of the drilling line 125, known as a dead line anchor, may be anchored to a fixed position, possibly near the drawworks 130 or elsewhere on the rig.

A hook 135 may be attached to the bottom of the traveling block 120. A top drive 140 may be suspended from the hook 135. A quill 145 extending from the top drive 140 may be attached to a saver sub 150, which may be attached to a drill string 155 suspended within a wellbore 160. Alternatively, the quill 145 may be attached to the drill string 155 directly.

The drill string 155 can include interconnected sections of drill pipe 165, a bottom hole assembly (BHA) 170, and a drill bit 175. The bottom hole assembly 170 may include stabilizers, drill collars, and/or measurement-while-drilling (MWD) or wireline conveyed instruments, among other components. The drill bit 175, which may also be referred to herein as a tool, may be connected to the bottom of the BHA 170 or may be otherwise attached to the drill string 155. One or more pumps 180 may deliver drilling fluid to the drill string 155 through a hose or other conduit 185, which may be connected to the top drive 140. It will be appreciated that the one or more pumps 180 may include a mud pump system and/or a manifold. It will also be appreciated that the location of the one or more pumps 180 may be on or off the rig floor 110 depending on available space.

The downhole MWD or wireline conveyed instruments may be configured for the evaluation of physical properties such as pressure, temperature, torque, weight-on-bit (WOB), vibration, inclination, azimuth, toolface orientation in three-dimensional space, and/or other downhole parameters. These measurements may be made downhole, stored in solid-state memory for some time, and downloaded from the instrument(s) at the surface and/or transmitted real-time to the surface. Data transmission methods may include, for example, digitally encoding data and transmitting the encoded data to the surface, possibly as pressure pulses in the drilling fluid or mud system, acoustic transmission through the drill string 155, electronic transmission through a wireline or wired pipe, and/or transmission as electromagnetic pulses. The MWD tools and/or other portions of the BHA 170 may have the ability to store measurements for later retrieval via wireline and/or when the BHA 170 may be tripped out of the wellbore 160.

In an exemplary embodiment, the system 100 may also include a rotating control device (RCD) 158, such as if the well 160 is being drilled utilizing under-balanced or managed-pressure drilling methods. In such embodiment, the annulus mud and cuttings may be pressurized at the surface, with the actual desired flow and pressure being controlled by the SSPC and the one or more pumps 180, with the fluid and pressure being maintained at the well head and directed down the flow line to the SSPC by the RCD 158. The system 100 may also include a surface casing annular pressure sensor 159 configured to detect the pressure in the annulus 162 defined between, for example, the wellbore 160 (or casing therein) and the drill string 155.

In the exemplary embodiment depicted in FIG. 1, the top drive 140 may be utilized to impart rotary motion to the drill string 155. However, aspects of the present disclosure are also applicable or readily adaptable to implementations utilizing other drive systems, such as a power swivel, a rotary table, a coiled tubing unit, a downhole motor, and/or a conventional rotary rig, among others.

The system 100 also includes a controller 190 configured to control or assist in the control of one or more components of the system 100. For example, the controller 190 may be configured to transmit operational control signals to the drawworks 130, the top drive 140, the BHA 170, the SSPC, and/or the pump 180. The controller 190 may be a stand-alone component installed near the mast 105 and/or other components of the system 100. In an exemplary embodiment, the controller 190 includes one or more systems located in a control room proximate the system 100, such as the general purpose shelter often referred to as the "doghouse" serving as a combination tool shed, office, communications center, and general meeting place. The controller 190 may be configured to transmit the operational control signals to the drawworks 130, the top drive 140, the BHA 170, the SSPC, and/or the pump(s) 180 via wired or wireless transmission means which, for the sake of clarity, are not depicted in FIG. 1.

The controller 190 may also be configured to receive electronic signals via wired or wireless transmission means (also not shown in FIG. 1) from a variety of sensors included in the system 100, where each sensor may be configured to detect an operational characteristic or parameter. One such sensor may be the surface casing annular pressure sensor 159 described above. The system 100 may include a downhole annular pressure sensor **170*a* coupled to or otherwise associated with the BHA 170. The downhole annular pressure sensor 170*a* may be configured to detect a pressure value or range in the annulus 162 defined between the external surface of the BHA 170 and the internal diameter of the wellbore 160**, which may also be referred to as the casing pressure, downhole casing pressure, MWD casing pressure, downhole annular pressure, or bottom hole pressure (BHP). These measurements may include both static annular pressure (pumps off) and active annular pressure (pumps on).

It is noted that the meaning of the words "detecting" or "determining," in the context of the present disclosure, may include detecting, sensing, measuring, calculating, and/or otherwise obtaining data. Similarly, the meaning of the words "detect" or "determine," in the context of the present disclosure may include detect, sense, measure, calculate, and/or otherwise obtain data.

The system 100 may additionally or alternatively include a shock/vibration sensor **170*b* that may be configured for detecting shock and/or vibration in the BHA 170. The system 100 may additionally or alternatively include a mud motor delta pressure ($\Delta P$) sensor 172*a* that may be configured to detect a pressure differential value or range across one or more motors 172 of the BHA 170. The one or more motors 172 may each be or include a positive displacement drilling motor that uses hydraulic power of the drilling fluid to drive the bit 175, also known as a mud motor. One or more torque sensors 172*b* may also be included in the BHA 170** for sending data to the controller 190 that may be indicative of the torque applied to the bit 175 by the one or more motors 172.

The system 100 may additionally or alternatively include toolface sensors 170*c*, 170*d* configured to detect the current toolface orientation. The toolface sensors can be a magnetic toolface sensor, a gravity toolface sensor, a toolface sensor that includes a gyro sensor, or combinations thereof. The system 100 may additionally or alternatively include a WOB sensor 170*d* integral to the BHA 170 and configured to detect WOB at or near the BHA 170.

The system 100 may additionally or alternatively include a torque sensor 140*a* coupled to or otherwise associated with the top drive 140. The torque sensor 140*a* may alternatively, or in addition to, be located in or associated with the BHA 170. The torque sensor 140*a* may be configured to detect a value or range of the torsion of the quill 145 and/or the drill string 155 (e.g., in response to operational forces acting on the drill string). The top drive 140 may additionally or alternatively include or otherwise be associated with a speed sensor 140*b* configured to detect a value or range of the rotational speed of the quill 145.

The top drive 140, draw works 130, crown or traveling block, drilling line or dead line anchor may additionally or alternatively include or otherwise be associated with a WOB sensor 140*c* (WOB calculated from a hook load sensor that can be based on active and static hook load) (e.g., one or more sensors installed somewhere in the load path mechanisms to detect and calculate WOB, which can vary from rig-to-rig) different from the WOB sensor 170*d*. The WOB sensor 140*c* may be configured to detect a WOB value or range, where such detection may be performed at the top drive 140, draw works 130, or other component of the system 100.

The detection performed by the sensors described herein may be performed once, continuously, periodically, and/or at random intervals. The detection may be manually triggered by an operator or other person accessing a human-machine interface (HMI), or automatically triggered by, for example, a triggering characteristic or parameter satisfying a predetermined condition (e.g., expiration of a time period, drilling progress reaching a predetermined depth, drill bit usage reaching a predetermined amount, etc.). Such sensors and/or other detection means may include one or more interfaces which may be local at the well/rig site or located at another, remote location with a network link to the system. These various sensors can transmit their sensor data to the controller 190, which can use the sensor data to determine actual BHP.

Figure 2:
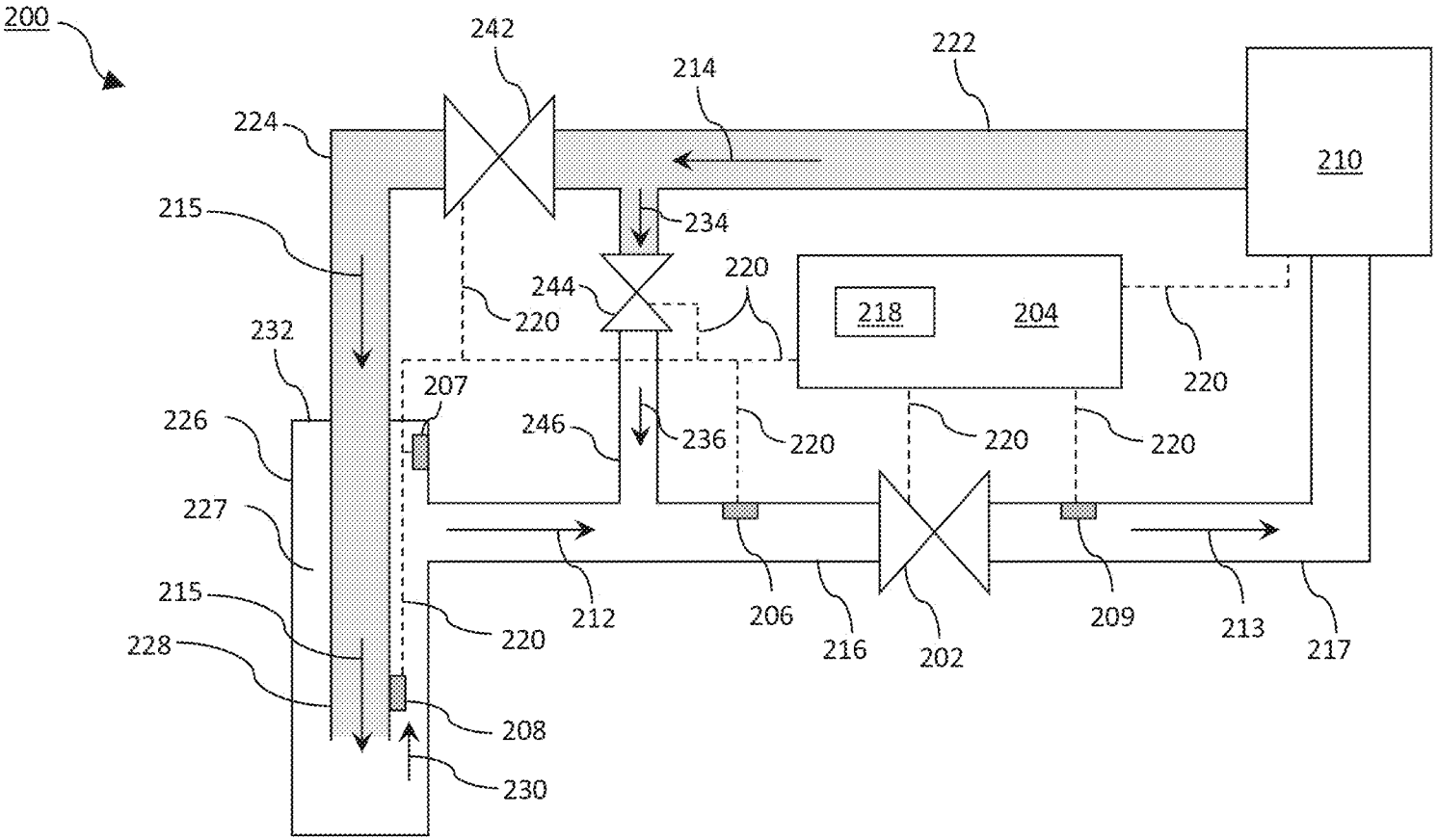
FIG. 2 is a schematic diagram of a system according to one or more aspects of the present disclosure.

FIG. 2 is a schematic diagram of a system 200 according to one or more aspects of the present disclosure. The system 200 can be a closed loop system with fluid 214 flowing through a stand pipe 222 through a top drive (not shown) to a top pipe segment 224 of a drill string 228. The fluid 214 can flow through the drill string 228 and exit the drill string 228 through a drill bit (not shown) as fluid flow 215. The fluid flow 215 can carry away the drill cuttings in fluid flow 230 through the annulus 227 back toward the surface to exit the annulus 227 as fluid flow 212 in passage 216 just below the rotating blowout preventer 232 at a wellhead. The fluid flow 212 can flow through the SSPC 202 and continue through the passage 217 as flow 213 to be received by the one or more pumps 210. It should be understood that the fluid flow 213 may not flow directly to the pump(s) as indicated in FIG. 2. Instead the fluid flow 213 may flow through a shaker to remove the cuttings and into a reservoir, where the pump(s) may pull the fluid from the reservoir to recirculate the fluid into the standpipe 222 as fluid flow 214. During managed pressure drilling (MPD) a pressure profile can be maintained along the wellbore by adjusting several parameters of the system 200, such as fluid density, pump speed, and back pressure caused by restrictions to flow through the SSPC 202, etc.

A sensor 206 may be configured to measure flow conditions within the passage 216 and a sensor 209 may be configured to measure flow conditions within the passage 217. Another sensor 207 may be configured to measure annulus pressure near the surface, proximate the rotating blowout preventer 232. Yet another sensor 208 may be included in a bottom hole assembly and configured to directly measure bottom hole pressure. These sensors may be capable of measuring one or more flow conditions including pressure, flow rate, fluid density, fluid temperature, inlet pressure, outlet pressure, viscosity, inlet velocity, and outlet velocity and generating one or more signals to the controller based on the flow conditions. These sensors 206, 207, 208, 209 may send signals through means including wireless and wired transmission. The communication paths 220 shown in FIG. 2 indicate a coupling of the sensors to the controller 204, which can be performed via wired or wireless transmission. In some embodiments, the sensors 206, 207, 208, 209 may be coupled to a logic device 218 of the controller 204. It should be understood that more of fewer sensors can be used in keeping with the principles of this disclosure.

The logic device 218 may be configured to receive the signals from the sensors 206, 207, 208, 209 and determine various characteristics of the system 200, such as surface back pressure, bottom hole pressure (BHP), flow passage pressure, flow rates, fluid velocity, etc. The controller may be configured to 1) determine the BHP directly from the sensor measurements, 2) calculate the BHP based on measurements of drill string true vertical depth (TVD), drill string measured depth (MD), drilling fluid density, annulus fluid volume, drill string fluid volume, friction loss (at a specific flow rate and control point), pressure while drilling (PWD), measurement while drilling (MWD) and combinations thereof, 3) receive the BHP from an offline hydraulics modeling program, and/or 4) receive the BHP from an operator via a human machine interface (HMI) or from another controller such as a Programmable Logic Controller (PLC).

After analyzing the signals from the sensors 206, 207, 208, 209 the logic device 218 may generate instructions that may be used by the controller 204 to change the state of the SSPC 202. In other embodiments, the logic device 218 may use the signals relating to measurements from the sensors 206, 207, 208, 209 to generate a flow value that may indicate characteristics of the fluid in the fluid flow 212. In some embodiments, the logic device 218 may be communicatively connected to the controller 204 via wired or wireless communication.

As the wellbore is extended into an earthen formation, additional drill pipe segments are added to lengthen the drill string 228. During a connection of a new pipe segment to the top pipe segment 224, the circulation of the drilling fluid through the drill string 228 is interrupted to allow disconnection of the top pipe segment 224 from the top drive (not shown). However, during MPD, it is desirable to have the system 200 maintain the BHP within a desired pressure range and thereby maintain the pressure profile of the wellbore 226 within a desired range. Therefore, the system 200 can provide a bypass passage 246 from the output of the pump(s) 210 to the passage 216 to control the back pressure in the annulus produced by a flow restriction through the SSPC 202. When a new pipe segment connection is to be made, the controller 204 may ramp the pump(s) 210 down to reduce fluid flow 214 and 215 through the standpipe 222 and the drill string 228, respectively. The controller 204 may also begin closing the valve 242 while opening valve 244, which diverts fluid flow 234 from the standpipe 222 to the bypass passage 246 as fluid flow 236, which can enter the passage 216 and comingle with fluid flow 212.

When the valve 242 is fully closed, fluid flow 215 is stopped, allowing the top pipe segment 224 to be disconnected from the top drive and a new pipe segment attached to the top pipe segment 224, thereby extending the length of the drill string 228. With the valve 242 closed and the valve 244 open, the controller 204 can manage the pressure in the annulus by adjusting the pump(s) 210 and the SSPC. The back pressure created by the pump(s) and the SSPC flow restriction is communicated to the annulus to maintain the BHP during the connection operation. The controller 204 can receive a BHP set point for the connection operation, compare the BHP to the BHP set point, and adjust the pump(s) 210 and the SSPC to increase or decrease the BHP as needed to track the BHP set point. The adjustments of the BHP can include sending one or more pressure set points to the SSPC so that the SSPC automatically adjusts the choke in the SSPC to track the pressure set point. The pressure set point can be compared to an inlet pressure of the SSPC with the SSPC adjusting the flow restriction through the SSPC to track the set point pressure. The pressure set point sent to the SSPC may be changed as needed throughout the connection process. As used herein, "track" or "tracking" a set point refers to a parameter being adjusted up or down to approach a set point parameter value. Therefore, "track" or "tracking" the set point may include the parameter being above or below the set point parameter value (i.e. +/− the set point parameter value) by an acceptable amount, but adjusting the parameter toward the set point value.

Figure 3:
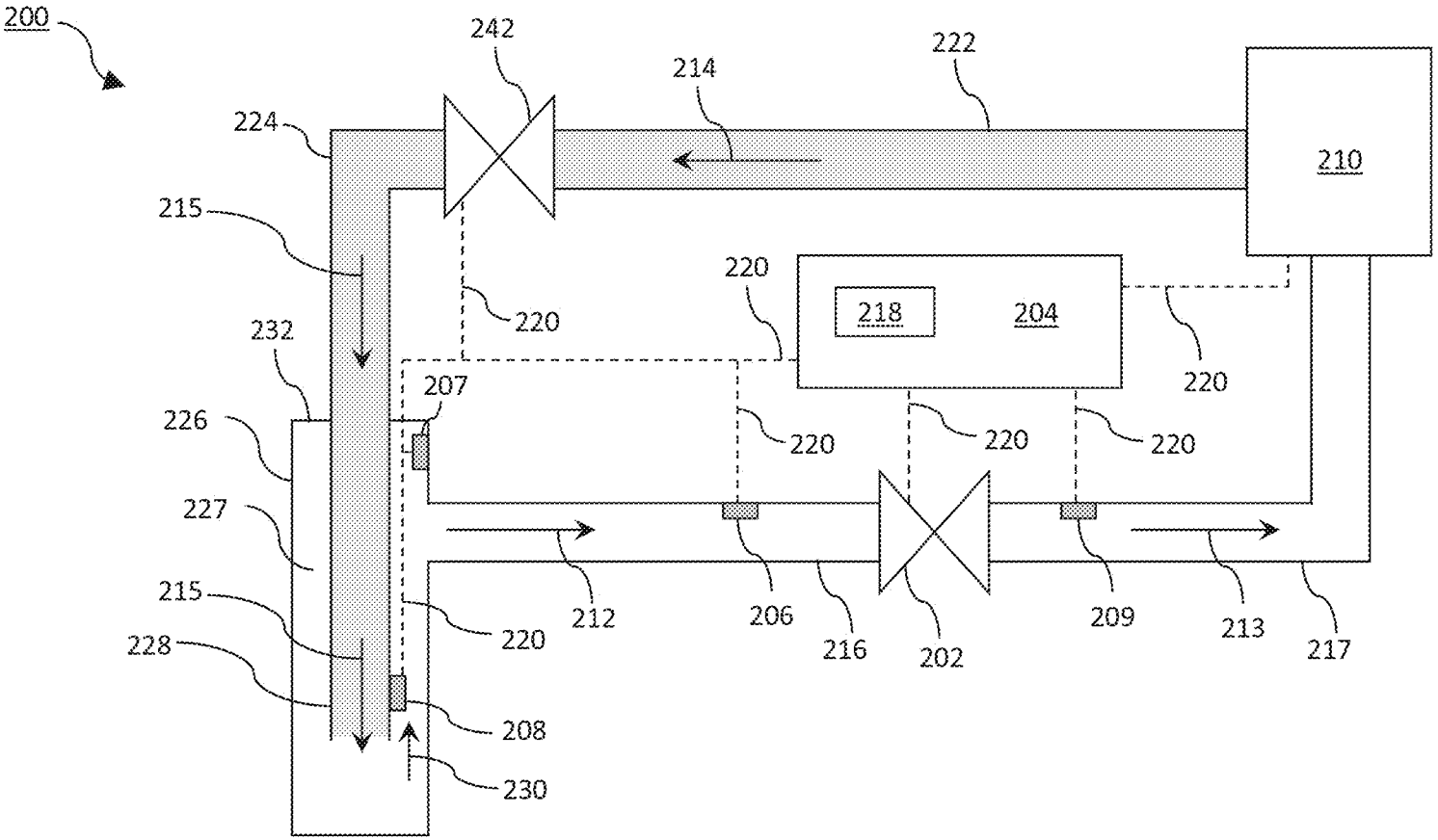
FIG. 3 is another schematic diagram of the system according to one or more aspects of the present disclosure.

FIG. 3 is another schematic diagram of the system 200 according to one or more aspects of the present disclosure. The system 200 in FIG. 3 is similar to the system 200 in FIG. 2, except that the bypass passage 246 and the valve 244 are not included. In this embodiment, the BHP is maintained by trapping pressure in the annulus 227 prior to stopping flow of the drilling fluid and the disconnection of the drill string 228 from the top drive (not shown). Items in FIG. 3 with the same reference numeral as the items in FIG. 2 can provide the same functionality as for the system 200 of FIG. 3.

In this embodiment, drilling fluid circulates through the system as fluid flows 214, 215, 230, 212, and 213 as above. The controller 204 is coupled to the system 200 components via the communication paths 220, which can be wired or wireless communication paths. When a new pipe segment is to be added to the drill string 228, then the flow restriction through the SSPC can be further restricted to increase the surface back pressure at the surface as the pumps are being ramped down and the flow of drilling fluid is decreased. This increase in the surface backpressure can compensate for a change in the ECD and other parameters that impact the BHP. For example, as the drilling fluid flow decreases, the ECD will also decrease, which can cause the BHP to decrease. However, by increasing the flow restriction through the SSPC, the BHP can be maintained at a desired level through the connection process by increasing the surface backpressure to compensate.

With the fluid flow 215 stopped, the drill string 228 can be disconnected from the top drive, the new pipe segment attached to the top pipe segment 224, and the lengthened drill string 228 can be again connected to the top drive. When the drill string 228 is again connected to the top drive, the pump(s) 210 can be incrementally ramped up and the valve 202 incrementally opened to allow drilling fluid to circulate through the system 200 again and allow further drilling into the formation.

Figure 4:
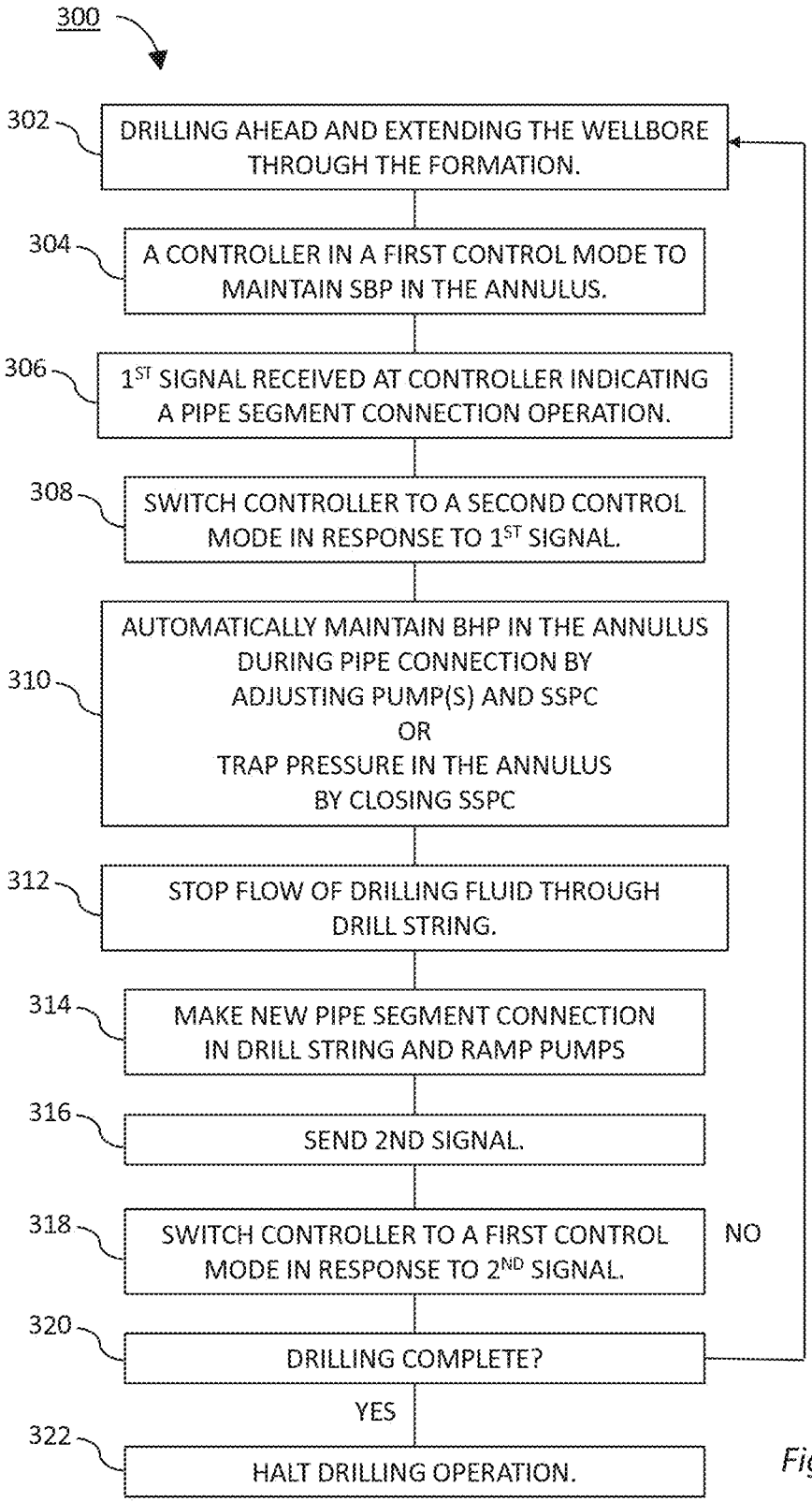
FIG. 4 is a flow-chart diagram of a method according to one or more aspects of the present disclosure.

The method 300 in FIG. 4 may be performed in association with one or more components of the system 100 shown in FIG. 1 during operation of the system 100. The method 300 in FIG. 4 may also be performed in association with one or more components of the system 200 shown in FIGS. 2 and 3 during operation of the system 200. For example, the method 300 may be performed for managing pressure during drilling operations performed via the systems 100, 200. The reference numerals in the description below of the method 300 refer to elements in FIGS. 1-3 for purposes of discussion. However, this method is not limited to these particular elements shown in these figures.

The method 300 can include an operation 302 where a drill string is used to drill ahead and extend a wellbore 160, 226 through a formation. During the drilling operation, as indicated by operation 304, a controller 190, 204 can be configured in a first control mode that is used to manually control a surface back pressure (SBP) in the annulus 162, 227 of the wellbore 160, 226. As used herein, "manual control" refers to an operator(s) determining a set point pressure for the SSPC to maintain the SBP in the annulus and inputting the set point pressure to the controller 190, 204 which transfers the set point pressure to the SSPC. The SSPC automatically adjusts its choke element to track the set point pressure. However, the controller does not, in this first mode, compare the actual SBP to a desired SBP and adjust the set point pressure to the SSPC to maintain the SBP. In the first control mode, the system is relying on the operators to manage the SSPC settings to maintain the SBP. The operators may input the set point pressure to the controller via a human machine interface, such as a touch screen, push button, dial input, etc. This can support a much simpler and more economical control strategy for the systems 100, 200.

In operation 306, a signal may be received at the controller 190, 204 that indicates that a pipe segment connection is needed to lengthen the drill string 165, 228.

In operation 308, the controller 190, 204 can automatically switch from the first control mode that manually maintains the SBP in the annulus 162, 227 to a second control mode that automatically maintains the BHP in the annulus 162, 227.

In operation 310, the controller 190, 204 takes over control of the system 200 to automatically maintain the BHP within a desired pressure range. The controller 190, 204 may receive a desired BHP set point from an offline hydraulics model and/or an operator through a human machine interface (HMI). The controller 190, 204 may then determine the BHP in the annulus in several ways. For example, the BHP can be determined by the controller using measurements of drill string true vertical depth (TVD), drill string measured depth (MD), drilling fluid density, annulus fluid volume, drill string fluid volume, friction loss (at a specific flow rate and control point), pressure while drilling (PWD), measurement while drilling (MWD) and combinations thereof. Alternatively, or in addition to, the BHP can be determined by a hydraulics model using measurements of drill string true vertical depth (TVD), drill string measured depth (MD), drilling fluid density, annulus fluid volume, drill string fluid volume, friction loss (at a specific flow rate and control point), pressure while drilling (PWD), measurement while drilling (MWD) and combinations thereof. Alternatively, or in addition to, the BHP can be determined by receiving an input at the controller from a human machine interface. Alternatively, or in addition to, the BHP can be determined based inputs at the controller from another controller (such as a PLC). Alternatively, or in addition to, the BHP can be determined based on sensor data collected from one or more sensors in the wellbore.

Once the actual BHP (or estimated actual BHP) is determined, the controller 190, 204 may then compare the actual BHP to the BHP set point and automatically adjust the pumps 210 and the SSPC flow restriction to maintain the actual BHP within a desired range around and including the BHP set point. In one embodiment, the controller 190, 204 may trap pressure in the annulus 162, 227 such that when the drilling fluid is stopped in preparation of making the connection, the SSPC can be closed thereby trapping pressure in the wellbore to maintain the BHP through the connection process. The pressure can be increased prior to stopping the fluid flow by adjusting the SSPC to higher pressure set points prior to stopping fluid flow, in the wellbore.

In operation 312, once the desired BHP in the annulus 162, 227 is achieved, the controller 190, 204 can stop the pumps 180, 210 to stop flow of drilling fluid through the drill string 165, 228. Alternatively, or in addition to, a valve 242 can be closed to stop the flow of drilling fluid through the drill string 165, 228, with flow to the SSPC provided through the bypass valve 244.

In operation 314, the new pipe segment can be connected to the top of the drill string 165, 228 and the pumps ramped up.

In operation 316, the operator or an automated trigger can send a second signal to the controller 190, 204 indicating the completion of the connection.

Additionally, in operations 310-316, the controller 190, 204 automatically maintains the actual BHP within a desired pressure range by continuing to compare the actual BHP with the BHP set point and adjusting the SSPC (and pumps in some embodiments) to cause the actual BHP to track the BHP set point.

In operation 318, the controller 190, 204 automatically switches, based on the second signal, from the second control mode back to the first control mode that manually controls the SBP in the annulus.

In operation 320, if the drilling operation is not yet completed, then return to operation 302 to continue drilling ahead. If the drilling operation is complete then proceed to operation 322.

In operation 322, the drilling operation is complete and drilling operations cease.

Figure 5:
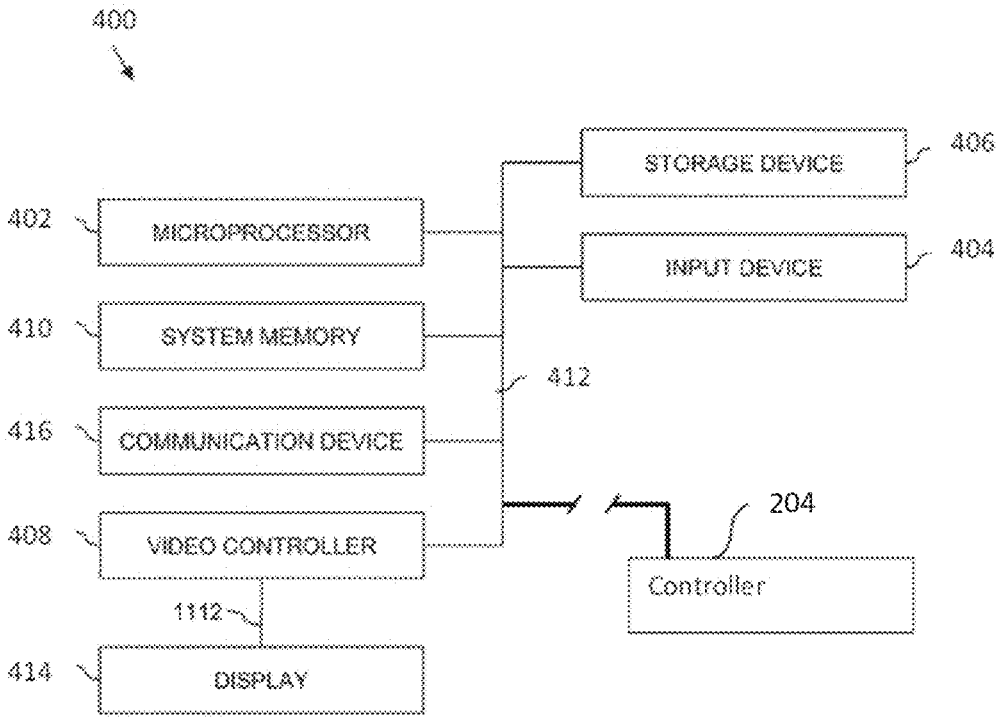
FIG. 5 is an exemplary system 400 for implementing one or more embodiments of at least portions of the system and/or methods described herein.

Referring to FIG. 5, illustrated is an exemplary system 400 for implementing one or more embodiments of at least portions of the system, methods, or systems described herein. The system 400 includes a microprocessor 402, an input device 404, a storage device 406, a video controller 408, a system memory 410, a display 414, and a communication device 416, all interconnected by one or more buses 412. In some embodiments, the exemplary system 400 may be connected to the controller 204.

The system 400 may represent components of the controller 204 described in some embodiments herein. In some embodiments the microprocessor 402 may represent the logic device 218 capable of enabling embodiments described herein.

The storage device 406 may be a floppy drive, hard drive, CD, DVD, optical drive, solid state drive, thumb drive, USB drive, or any other form of storage device. In addition, the storage device 406 may be capable of receiving a floppy disk, CD, DVD, or any other form of computer-readable medium that may contain computer-executable instructions.

The communication device 416 may be a modem, network card, or any other device to enable the system 400 to communicate with other systems.

A computer system typically includes at least hardware capable of executing machine readable instructions, as well as software for executing acts (typically machine-readable instructions) that produce a desired result. In addition, a computer system may include hybrids of hardware and software, as well as computer sub-systems.

Hardware generally includes at least processor-capable platforms, such as client-machines (also known as personal computers or servers), and hand-held processing devices (such as smart phones, PDAs, and personal computing devices (PCDs), for example). Furthermore, hardware typically includes any physical device that may be capable of storing machine-readable instructions, such as memory or other data storage devices. Other forms of hardware include hardware sub-systems, including transfer devices such as modems, modem cards, ports, and port cards, for example. Hardware may also include, at least within the scope of the present disclosure, multi-modal technology, such as those devices and/or systems configured to allow users to utilize multiple forms of input and output—including voice, keypads, and stylus—interchangeably in the same interaction, application, or interface.

Software may include any machine code stored in any memory medium, such as RAM or ROM, machine code stored on other devices (such as floppy disks, CDs or DVDs, for example), and may include executable code, an operating system, as well as source or object code, for example. In addition, software may encompass any set of instructions capable of being executed in a client machine or server—and, in this form, is often called a program or executable code.

Hybrids (combinations of software and hardware) are becoming more common as devices for providing enhanced functionality and performance to computer systems. A hybrid may be created when what are traditionally software functions are directly manufactured into a silicon chip—this is possible since software may be assembled and compiled into ones and zeros, and, similarly, ones and zeros can be represented directly in silicon. Typically, the hybrid (manufactured hardware) functions are designed to operate seamlessly with software. Accordingly, it should be understood that hybrids and other combinations of hardware and software are also included within the definition of a computer system or controller herein, and are thus envisioned by the present disclosure as possible equivalent structures and equivalent methods.

Computer-readable mediums may include passive data storage such as a random access memory (RAM), as well as semi-permanent data storage such as a compact disk or DVD. In addition, an embodiment of the present disclosure may be embodied in the RAM of a computer and effectively transform a standard computer into a new specific computing machine.

Data structures are defined organizations of data that may enable an embodiment of the present disclosure. For example, a data structure may provide an organization of data or an organization of executable code (executable software). Furthermore, data signals are carried across transmission mediums and store and transport various data structures, and, thus, may be used to transport an embodiment of the invention. It should be noted in the discussion herein that acts with like names may be performed in like manners, unless otherwise stated.

The controllers and/or systems of the present disclosure may be designed to work on any specific architecture. For example, the controllers and/or systems may be executed on one or more computers, Ethernet networks, local area networks, wide area networks, internets, intranets, hand-held and other portable and wireless devices and networks.

Many different aspects and embodiments are possible. Some of those aspects and embodiments are described below. After reading this specification, skilled artisans will appreciate that those aspects and embodiments are only illustrative and do not limit the scope of the present invention. Embodiments can be in accordance with any one or more of the items as listed below.

VARIOUS EMBODIMENTS

Embodiment 1

A method for conducting a subterranean operation, the method comprising operations of receiving a first signal at a controller; switching the controller from a first control mode to a second control mode in response to receiving the first signal; determining a bottom hole pressure (BHP) in a wellbore; receiving a BHP set point at the controller and sending a first pressure set point to a single set point choke (SSPC); maintaining the BHP by adjusting the SSPC to track the first pressure set point; comparing the determined BHP to the BHP set point and adjusting the first pressure set point based on the comparing; receiving a second signal at the controller; and switching the controller back to the first control mode in response to the second signal.

Embodiment 2

The method of embodiment 1, further comprising trapping pressure in the annulus to maintain the BHP when the controller in is the second control mode.

Embodiment 3

The method of embodiment 1, further comprising switching from the first control mode to the second control mode for each one of multiple pipe segment connections of a drill string.

Embodiment 4

The method of embodiment 1, wherein the BHP is determined by the controller using measurements of drill string true vertical depth (TVD), drill string measured depth (MD), drilling fluid density, annulus fluid volume, drill string fluid volume, friction loss (at a specific flow rate and control point), pressure while drilling (PWD), measurement while drilling (MWD) and combinations thereof.

Embodiment 5

The method of embodiment 1, wherein the BHP is determined by a hydraulics model using measurements of drill string true vertical depth (TVD), drill string measured depth (MD), drilling fluid density, annulus fluid volume, drill string fluid volume, friction loss (at a specific flow rate and control point), pressure while drilling (PWD), measurement while drilling (MWD) and combinations thereof.

Embodiment 6

The method of embodiment 1, wherein the BHP is determined by receiving an input at the controller from a human machine interface.

Embodiment 7

The method of embodiment 1, wherein the BHP is determined based on sensor data collected from one or more sensors in the wellbore.

Embodiment 8

The method of embodiment 7, wherein the one or more sensors are disposed in a bottom hole assembly of a drill string.

Embodiment 9

The method of embodiment 1, wherein the maintaining the BHP further comprises adjusting a pump output by ramping up or down the pump to adjust fluid flow to the annulus.

Embodiment 10

The method of embodiment 9, wherein the first pressure set point comprises multiple first pressure set points, with each of the first pressure set points being sent by the controller at separate times to the SSPC during a ramp down of the pump during a connection of a pipe segment to a drill string.

Embodiment 11

The method of embodiment 1, further comprising determining a surface back pressure in an annulus of the wellbore; and via the controller in the first control mode, maintaining the surface back pressure within a first desired pressure range or maintaining the SSCP at a desired choke position while the wellbore is being drilled.

Embodiment 12

The method of embodiment 11, further comprising the controller receiving the first desired pressure range from a human machine interface.

Embodiment 13

A system for use in subterranean operations, the system comprising a managed pressure drilling assembly consisting of; a single choke; a pressure sensor; and a controller configured to change the mode of the single choke between a manual set point mode and an automated mode, wherein in the automated mode the controller is configured to receive pressure data and continuously send instructions to a choke controller to maintain a bottom hole pressure (BHP) within a first desired pressure range, and wherein the choke controller is configured to control a state of the single choke based on the instructions.

Embodiment 14

The system of embodiment 13, wherein the single choke is a single set point choke.

Embodiment 15

The system of embodiment 13, wherein the single choke is the only choke adjusted by the controller to maintain the BHP within the first desired pressure range.

Embodiment 16

The system of embodiment 15, wherein the BHP is determined based on sensor data collected from the pressure sensor.

Embodiment 17

The system of embodiment 15, wherein the BHP is determined by the controller using measurements of drill string true vertical depth (TVD), drill string measured depth (MD), drilling fluid density, annulus fluid volume, drill string fluid volume, friction loss (at a specific flow rate and control point), pressure while drilling (PWD), measurement while drilling (MWD) and combinations thereof.

Embodiment 18

The system of embodiment 15, wherein the BHP is determined by a hydraulics model using measurements of drill string true vertical depth (TVD), drill string measured depth (MD), drilling fluid density, annulus fluid volume, drill string fluid volume, friction loss (at a specific flow rate and control point), pressure while drilling (PWD), measurement while drilling (MWD) and combinations thereof.

Embodiment 19

The system of embodiment 18, wherein the BHP is determined by an input received by the controller from a human machine interface.

Embodiment 20

The system of embodiment 13, wherein the controller, in the manual set point mode, adjusts the single choke to maintain a surface back pressure in the annulus within a second desired pressure range and switches to a automated mode when a first signal is received by the controller, and wherein the controller, in the automated mode, automatically adjusts the single choke to maintain the BHP within the first desired pressure range.

The foregoing embodiments represent a departure from the state-of-the-art. Notably, the embodiments herein include a combination of features not previously recognized in the art and facilitate performance improvements. Such features can include, but are not limited to, reduced wear on chokes, longer lifetime of chokes, better planning for maintenance on chokes, and a combination thereof. The embodiments herein have demonstrated remarkable and unexpected improvements over state-of-the-art managed pressure drilling systems.

Any foregoing methods and systems for managing wear on chokes may be combined with any of the other methods or systems to facilitate the management of wear on chokes in managed pressure drilling systems.

The above-disclosed subject matter is to be considered illustrative, and not restrictive, and the appended claims are intended to cover all such modifications, enhancements, and other embodiments, which fall within the true scope of the present invention. Thus, to the maximum extent allowed by law, the scope of the present invention is to be determined by the broadest permissible interpretation of the following claims and their equivalents, and shall not be restricted or limited by the foregoing detailed description.

The Abstract of the Disclosure is provided to comply with Patent Law and is submitted with the understanding that it will not be used to interpret or limit the scope or meaning of the claims. In addition, in the foregoing Detailed Description of the Drawings, various features may be grouped together or described in a single embodiment for the purpose of streamlining the disclosure. This disclosure is not to be interpreted as reflecting an intention that the claimed embodiments require more features than are expressly recited in each claim. Rather, as the following claims reflect, inventive subject matter may be directed to less than all features of any of the disclosed embodiments. Thus, the following claims are incorporated into the Detailed Description of the Drawings, with each claim standing on its own as defining separately claimed subject matter.

What is claimed is:

1. A method for conducting a subterranean operation, the method comprising:

receiving a first signal at a controller;

switching the controller from a first control mode to a second control mode in response to receiving the first signal;

determining a bottom hole pressure (BHP) in a wellbore;

receiving a BHP set point at the controller and sending a first pressure set point to a single set point choke (SSPC);

maintaining the BHP by adjusting the SSPC to track the first pressure set point;

comparing the determined BHP to the BHP set point and adjusting the first pressure set point based on the comparing;

receiving a second signal at the controller; and switching the controller back to the first control mode in response to the second signal.

2. The method of claim 1, further comprising trapping pressure in the annulus to maintain the BHP when the controller in is the second control mode.

3. The method of claim 1, further comprising switching from the first control mode to the second control mode for each one of multiple pipe segment connections of a drill string.

4. The method of claim 1, wherein the BHP is determined by the controller using measurements of drill string true vertical depth (TVD), drill string measured depth (MD), drilling fluid density, annulus fluid volume, drill string fluid volume, friction loss (at a specific flow rate and control point), pressure while drilling (PWD), measurement while drilling (MWD) and combinations thereof.

5. The method of claim 1, wherein the BHP is determined by a hydraulics model using measurements of drill string true vertical depth (TVD), drill string measured depth (MD), drilling fluid density, annulus fluid volume, drill string fluid volume, friction loss (at a specific flow rate and control point), pressure while drilling (PWD), measurement while drilling (MWD) and combinations thereof.

6. The method of claim 1, wherein the BHP is determined by receiving an input at the controller from a human machine interface or another controller.

7. The method of claim 1, wherein the BHP is determined based on sensor data collected from one or more sensors in the wellbore.

8. The method of claim 7, wherein the one or more sensors are disposed in a bottom hole assembly of a drill string.

9. The method of claim 1, wherein the maintaining the BHP further comprises adjusting a pump output by ramping up or down the pump to adjust fluid flow to the annulus.

10. The method of claim 9, wherein the first pressure set point comprises multiple first pressure set points, with each of the first pressure set points being sent by the controller at separate times to the SSPC during a ramp down of the pump during a connection of a pipe segment to a drill string.

11. The method of claim 1, further comprising:

determining a surface back pressure in an annulus of the wellbore; and via the controller in the first control mode, maintaining the surface back pressure within a first desired pressure range or maintaining the SSCP at a desired choke position while the wellbore is being drilled.

12. The method of claim 11, further comprising the controller receiving the first desired pressure range from a human machine interface.

13. A system for use in subterranean operations, the system comprising:

a managed pressure drilling assembly consisting of:

a single choke;

a pressure sensor; and a controller configured to change the mode of the single choke between a manual set point mode that maintains a surface backpressure during drilling and an automated mode that automatically maintains a bottom hole pressure (BHP) based on a BHP set point during drill pipe connections, wherein in the automated mode the controller is configured to receive pressure data and continuously send instructions to a choke controller to maintain the BHP within a first desired pressure range, and wherein the choke controller is configured to control a state of the single choke based on the instructions.

14. The system of claim 13, wherein the single choke is a single set point choke.

15. The system of claim 13, wherein the single choke is the only choke adjusted by the controller to maintain the BHP within the first desired pressure range.

16. The system of claim 15, wherein the BHP is determined based on sensor data collected from the pressure sensor.

17. The system of claim 15, wherein the BHP is determined by the controller using measurements of drill string true vertical depth (TVD), drill string measured depth (MD), drilling fluid density, annulus fluid volume, drill string fluid volume, friction loss (at a specific flow rate and control point), pressure while drilling (PWD), measurement while drilling (MWD) and combinations thereof.

18. The system of claim 15, wherein the BHP is determined by a hydraulics model using measurements of drill string true vertical depth (TVD), drill string measured depth (MD), drilling fluid density, annulus fluid volume, drill string fluid volume, friction loss (at a specific flow rate and control point), pressure while drilling (PWD), measurement while drilling (MWD) and combinations thereof.

19. The system of claim 18, wherein the BHP is determined by an input received by the controller from a human machine interface or another controller.

20. The system of claim 13, wherein the controller, in the manual set point mode, adjusts the single choke to maintain a surface back pressure in the annulus within a second desired pressure range and switches to a automated mode when a first signal is received by the controller, and wherein the controller, in the automated mode, automatically adjusts the single choke to maintain the BHP within the first desired pressure range.

* * * * *